United States Patent [19]

Verel

[11] Patent Number: 5,011,050

[45] Date of Patent: Apr. 30, 1991

[54] STEPPED GATE SAFETY ARRANGEMENT

[75] Inventor: Edward A. Verel, Valparaiso, Ind.

[73] Assignee: Leco Corporation, St. Joseph, Mich.

[21] Appl. No.: 606,764

[22] Filed: Oct. 31, 1990

[51] Int. Cl.[5] ..... B22D 41/34

[52] U.S. Cl. ..... 222/600; 222/597

[58] Field of Search ..... 222/590, 591, 597, 600, 222/603, 594; 266/236, 283

[56] References Cited

U.S. PATENT DOCUMENTS

| | | | |
|---|---|---|---|
| 3,436,023 | 4/1969 | Thalmann | 222/600 |
| 3,454,201 | 4/1969 | McShane | 222/600 |
| 3,866,806 | 2/1975 | Shapland | 222/600 |
| 3,918,613 | 11/1975 | Shapland, Jr. | 222/603 |
| 4,415,103 | 11/1983 | Shapland et al. | 222/590 |
| 4,545,512 | 10/1985 | Shapland et al. | 222/600 |

*Primary Examiner*—S. Kastler

*Attorney, Agent, or Firm*—B. J. Powell

[57] ABSTRACT

Apparatus for loading a gate into a valve mechanism with a gate safety arrangement for physically preventing the gate from being loaded into the valve mechanism unless the gate has a prescribed orientation with respect to the loading path into the valve mechanism.

14 Claims, 4 Drawing Sheets

STEPPED GATE SAFETY ARRANGEMENT

BACKGROUND OF THE INVENTION

This invention relates generally to slide gate valve mechanisms for controlling the flow of molten metal and more particularly to a gate safety arrangement which permits loading a gate into such a valve mechanism only when the gate has a predetermined orientation.

Valve mechanisms for controlling the flow of molten metal from a holding vessel are commonly available. One type of such valve mechanism uses slide gates which are first moved into a loaded position in the mechanism along a loading path and then moved into operative position in the mechanism along a firing path by a firing cylinder. These are commonly known as sequential type valve mechanisms. One configuration of these sequential type valve mechanisms both loads and fires the slide gates along a common path. Examples of this valve mechanism configuration are illustrated in:

| U.S. Pat. No. | Inventor | Issue Date |
|---|---|---|
| Re. 27,237 | J. T. Shapland | November 23, 1971 |
| 3,436,023 | A. Thalmann | April 1, 1969 |
| 3,454,201 | P. C. McShane | April 1, 1969 |
| 3,866,806 | E. P. Shapland | February 18, 1975 |

Another configuration of such sequential type valve mechanisms loads the slide gates along a loading path and then fires the slide gate into position along the firing path, perpendicular to the loading path. Example of this valve mechanism configuration are disclosed in:

| U.S. Pat. No. | Inventor | Issue Date |
|---|---|---|
| 4,415,103 | E. P. Shapland, et al. | November 15, 1983 |
| 4,545,512 | E. P. Shapland, et al. | October 8, 1985 |

This latter configuration typically uses a running gate with the hole, through which the molten metal flows, offset from the center of the gate. The offsetting of the hole facilitates throttling molten metal flow through the valve mechanism by moving the running gate laterally of the firing axis. The metal flow hole through the shroud plate in this configuration is typically centered on the metal flow hole through the top plate during operation. Both the running gate and shroud gate are typically rectilinear with a slightly greater length in one direction than in the other. Thus, these gates can be reversed as they are loaded into the valve mechanism.

The fact that the running gate can be reversed has posed problems over the years since inadvertently reversing the running gate has immediate and disastrous results. This is because the valve mechanism is typically set to a closed position during gate change and reversing the running gate installs the new gate in an almost fully open position. Further, a reversed gate causes the valve mechanism to operate backwards. That is, when the running gate is reversed, the normal fully open position is the fully closed position and the normal fully closed position is the fully open position. In addition, a reversed running gate prevents making any gas connections normally made directly to the running gate so that the molten metal being poured is typically downgraded to a less desirable grade of steel.

A reversed shroud gate may prevent making those gas connections normally made directly to the shroud gate or tubular shroud and cause a downgrading of the molten metal being poured.

SUMMARY OF THE INVENTION

These and other problems and disadvantages associated with the prior art are overcome by the invention disclosed herein by providing a means for assuring the proper orientation of the running gate and shroud gate in a sequential type valve mechanism or any other type of similarly loaded valve mechanism. The gates are physically prevented from being loaded into the valve mechanism to the loaded position for firing unless the gate is correctly oriented.

The apparatus of the invention includes different thickness shoulders along opposite side of the gate and a pre-positioning guide with a gauging opening therethrough complementary to the cross-sectional shape of the gate so that the gate will pass into the valve mechanism only when the gauging opening matches the shoulders on the gate. Thus, the gate can be loaded with only one orientation, Preferrably the thin shoulder on the gate is stepped so that the valve mechanism does not have to be internally modified.

These and other features and advantages of the invention will become more apparent upon consideration of the following detailed description and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

The gate safety arrangement of the invention is designed for use with either or both the running gate and the shroud gate in a conventional sequential type slide gate valve mechanism SGVM used to control the flow of molten metal from vessels. While such valve mechanisms SGVM may be used on either tundishes or ladles, they are most typically used on tundishes and the arrangement of the invention is illustrated mounted on a tundish TUN.

The valve mechanism SGVM with which the invention is illustrated is a sequential type slide gate valve mechanism such as that shown in U.S. Pat. No. 4,545,512, the disclosure of which is incorporated herein by reference. The valve mechanism SGVM is typically mounted on a tundish TUN as seen in FIG. 1.

Figure 1:
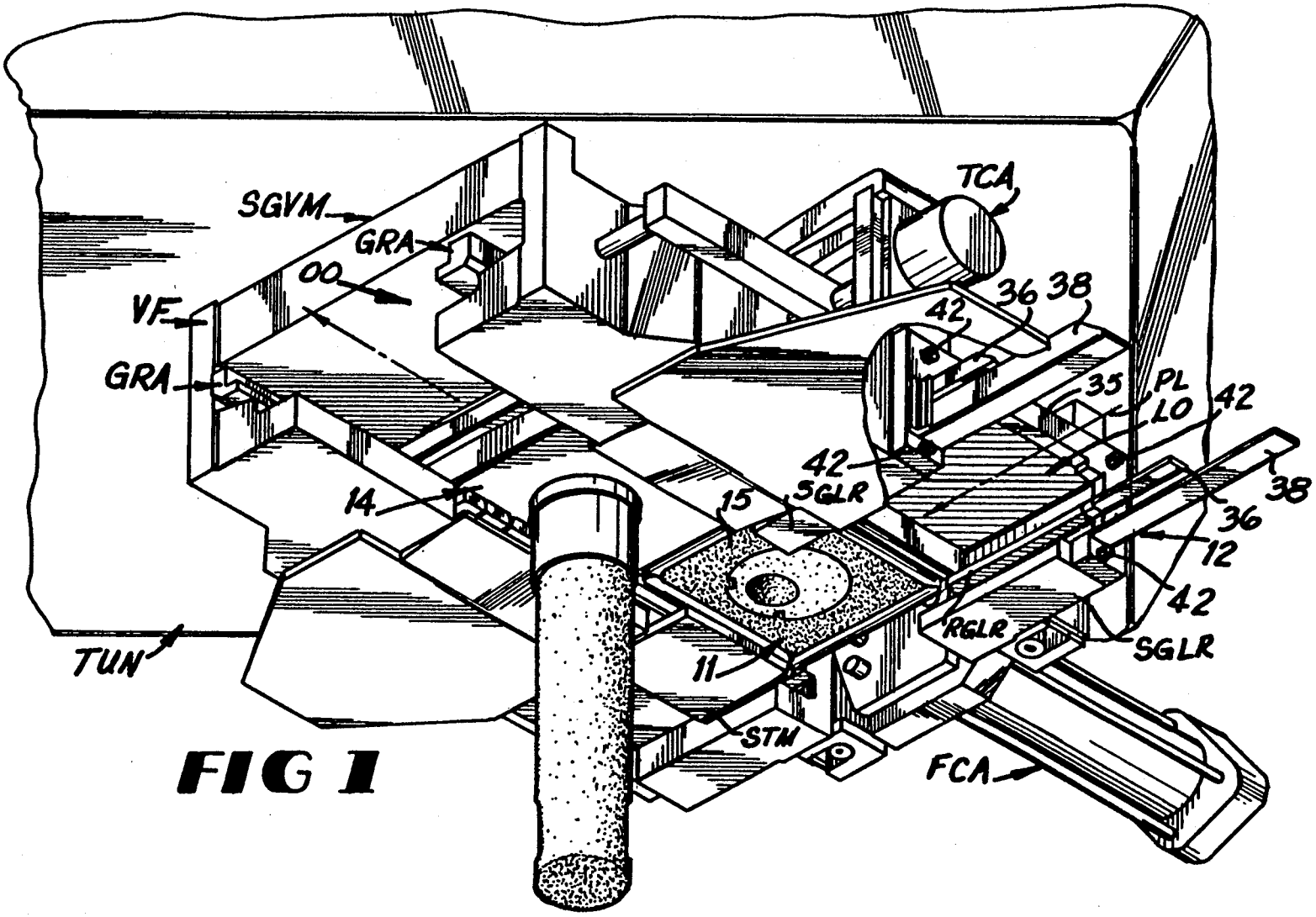
FIG. 1 is a perspective view of a valve mechanism with the invention installed.

Basically, the valve mechanism SGVM as seen in FIG. 1 includes a valve frame VF mounting a firing cylinder assembly FCA on one end and a pair of throttling cylinder assemblies TCA on opposite sides. The throttling cylinder assemblies TCA mount a guide rail assembly GRA within the frame VF to slidably support the running gates as will become apparent.

The main frame VF is generally horizontal during use and has an operating opening OO extending longitudinally through it along operating path $P_O$. A loading opening LO extends through frame VF along the loading path $P_L$ perpendicular to operating path $P_O$. Since the loading opening LO extends completely through the frame VF, the gates can be loaded from either side of the frame.

As best seen in FIG. 1, the frame VF has a pair of running gate loading rails RGLR that extend along opposite sides of the loading opening LO intermediate the height of the opening and a pair of shroud gate loading rails SGLR that extend along the loading opening LO below the running gate loading rails RGLR. Once that end of the loading opening LO to be used for the installation of the gates is selected, the opposite end of the opening LO is closed by a conventional stuffer member STM as seen in FIG. 1. The stuffer member STM serves to arrest the movement of the shroud gate as it is loaded into the valve mechanism along the loading opening LO.

The safety gate arrangement 10 best seen in FIGS. 2–6 includes a running gate 11 and a pre-positioning guide assembly 12 operatively associated with the gate 11 to permit the gate to loaded into the valve mechanism SGVM only when the gate is properly oriented. The safety gate arrangement 10 may also be used to load the shroud gate assembly 14 as will become apparent.

The running gate 11 corresponds to the refractory slide plate in U.S Pat. No. 4,545,512. The rectilinear gate 11 includes a running gate ceramic 15 mounted in a metal retainer 16 with mortar 18. The metal retainer 16 has a loading central axis $A_L$ and a firing central axis $A_F$ normal to the loading central axis $A_L$. The retainer 16 has a pair of generally L-shaped side walls $19_{TN}$ and $19_{TK}$ parallel to the loading central axis $A_L$ joined by a pair of L-shaped end walls 20 parallel to the firing central axis $A_F$. Each of the side walls 19 and end walls 20 join with a depending bottom lip 24 at their inner ends. The metal retainer 16 thus defines an upwardly opening ceramic receiving recess therein.

Figure 3:
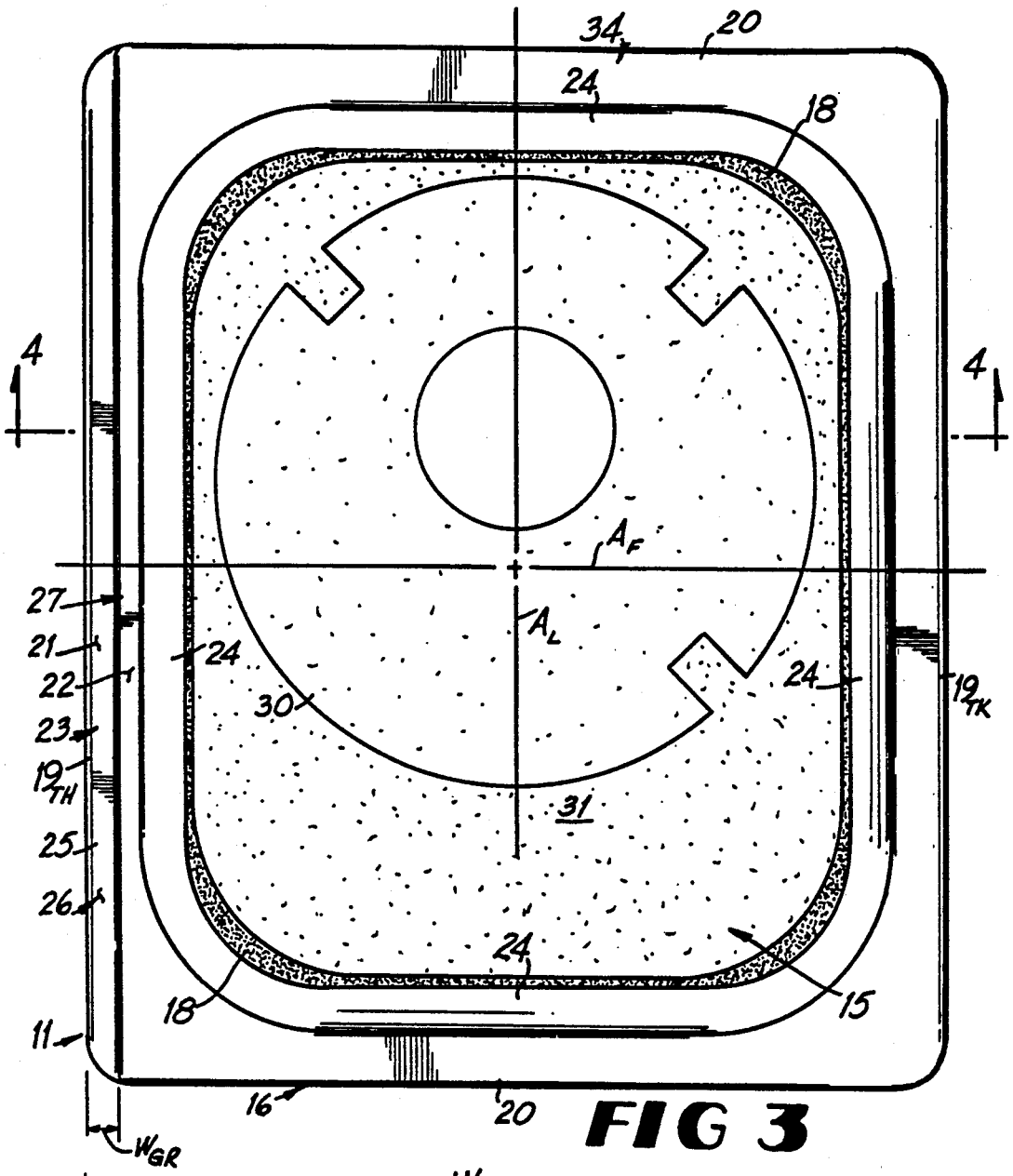
FIG. 3 an enlarged bottom view of the running gate incorporating the invention.
Figure 4:
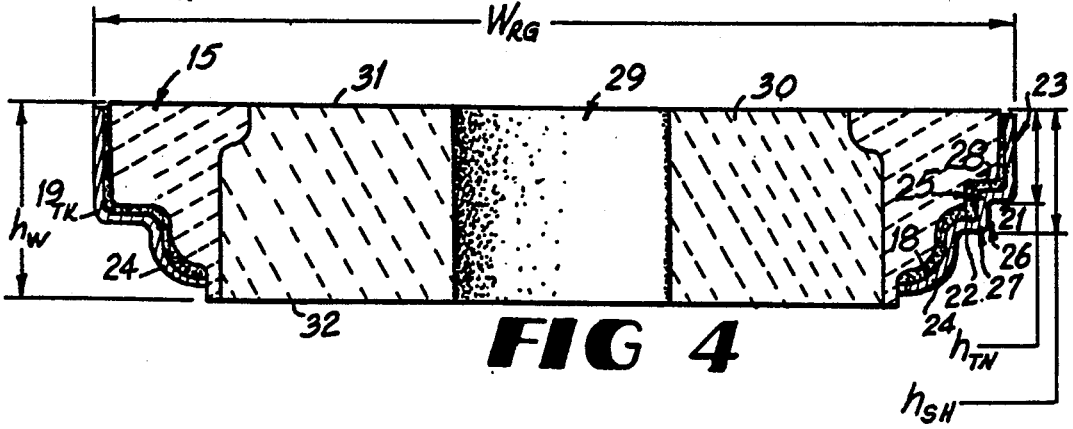
FIG. 4 is a cross-sectional view of the running gate taken along line 4—4 in FIG. 3.

The side wall $19_{TN}$ has a stepped section 25 formed therein defining a downwardly opening step recess 26 along the length of the side wall $19_{TN}$ and through the side walls 20. The step recess 26 opens onto the bottom of the gate 11 and also onto the side edge of the gate along the thinner side wall $19_{TN}$ as seen in FIGS. 3 and 4. The recess 26 is parallel to the outside side edge 21 of the wall $19_{TN}$ and has a transverse width $W_{GR}$ less than the distance from the lip 24 to the side edge 21. This produces a thinner section 23 adjacent the side edge 21 of the gate 11 and a thicker section 27 spaced inwardly of the side edge 21 the distance $W_{GR}$.

The running gate ceramic 15 conforms generally to the ceramic receiving recess in the metal retainer 16 with a mortar space in between. A clearance recess 28 is provided along the bottom of that side of the ceramic 15 overlying the recess section 25 in the thinner side wall $19_{TN}$ of retainer 16. The ceramic 15 defines a metal flow passage 29 therethrough which is offset from the firing central axis $A_F$ along the loading central axis $A_L$ as is typical for throttling running gates. The passage 29 may be formed in a refractory insert 30 positioned in the ceramic 15. The difference between the ceramic 15 and the prior art is the recess 28. The ceramic 15 defines an upper sealing surface 31 thereon to the plane defined by the axes $A_L$ and $A_F$ and a lower sealing surface 32 parallel to the surface 31. These surfaces from seals in the valve mechanism SGVM during metal pouring.

The gate 11 has an overall working height $h_W$ defined by the sealing surfaces 31 and 32. A thin shoulder height $h_{TN}$ is defined between the upper sealing surface 31 and the bottom surface 21 on the recess section 25 while a thick shoulder height $h_{SH}$ is defined between the bottom surface 22 on the thicker section 27 of side wall $19_{TN}$ and the upper sealing surface 31 as best seen in FIG. 4. The valve mechanism SGVM is internally designed to support gates 11 which have a shoulder height $h_{SH}$. Because the thicker section 27 still has the height $h_{SH}$, it is not necessary to internally modify the loading rails RGLR in the mechanism SGVM to support the gate 11. The height $h_{TN}$ is used as a gauge to control the orientation of gate 11 as will become more apparent.

The pre-positioning guide assembly 12 is mounted on the valve frame VF around the entrance to the loading opening LO as best seen in FIG. 1 and cooperates with the recess 26 in the retainer 16 of the gate 11 to permit the loading of the running gate 11 only when it is properly oriented. The guide assembly 12 includes a base member 35 which is removably attached to the valve frame VF, a pair of running gate guide angles 36 mounted on the base member 35 in registration with the running gate loading rails RGLR on the frame VF, and a pair of shroud gate guide angles 38 mounted on the base member 35 in registration with the shroud gate loading rails SGLR on the frame VF.

Figure 2:
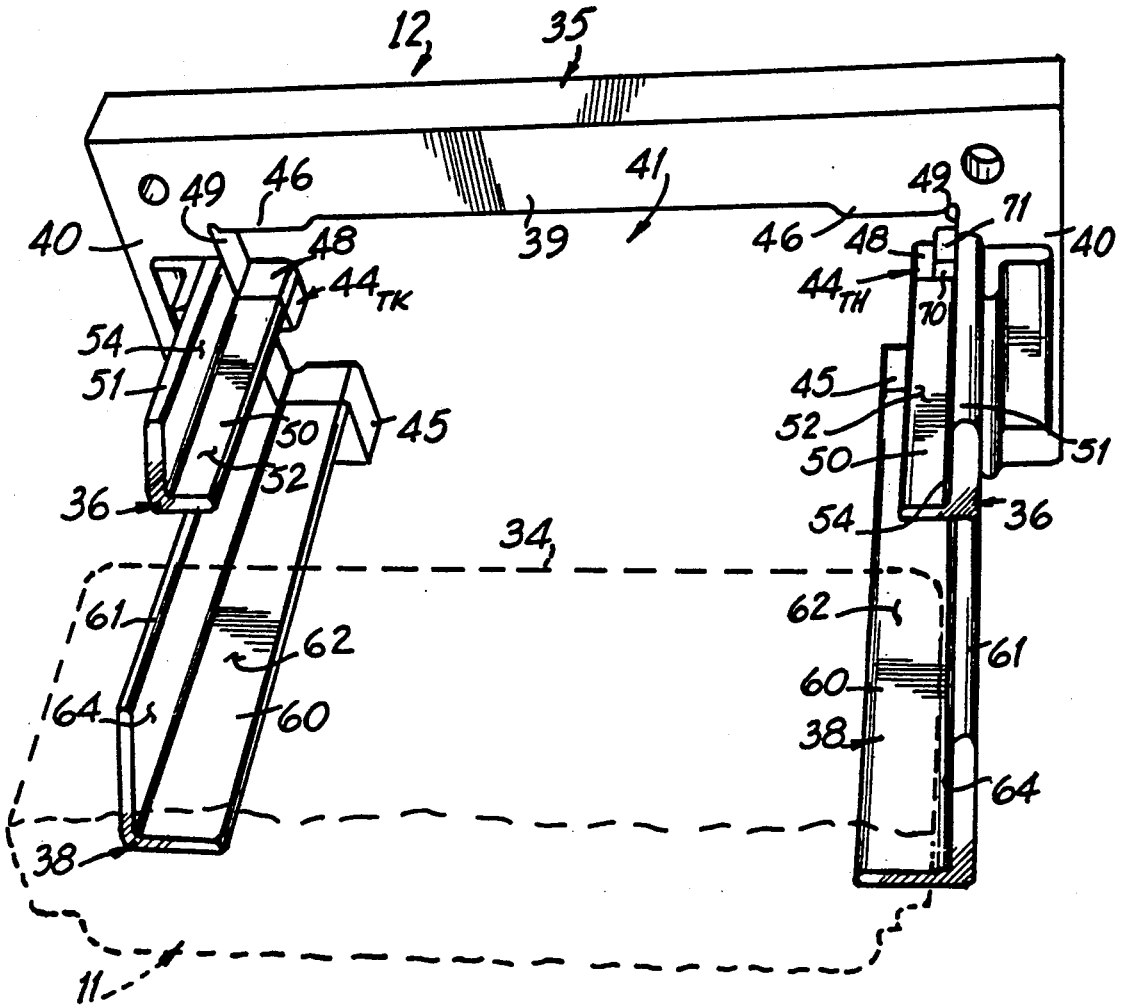
FIG. 2 is an enlarged perspective view of the invention.
Figure 5:
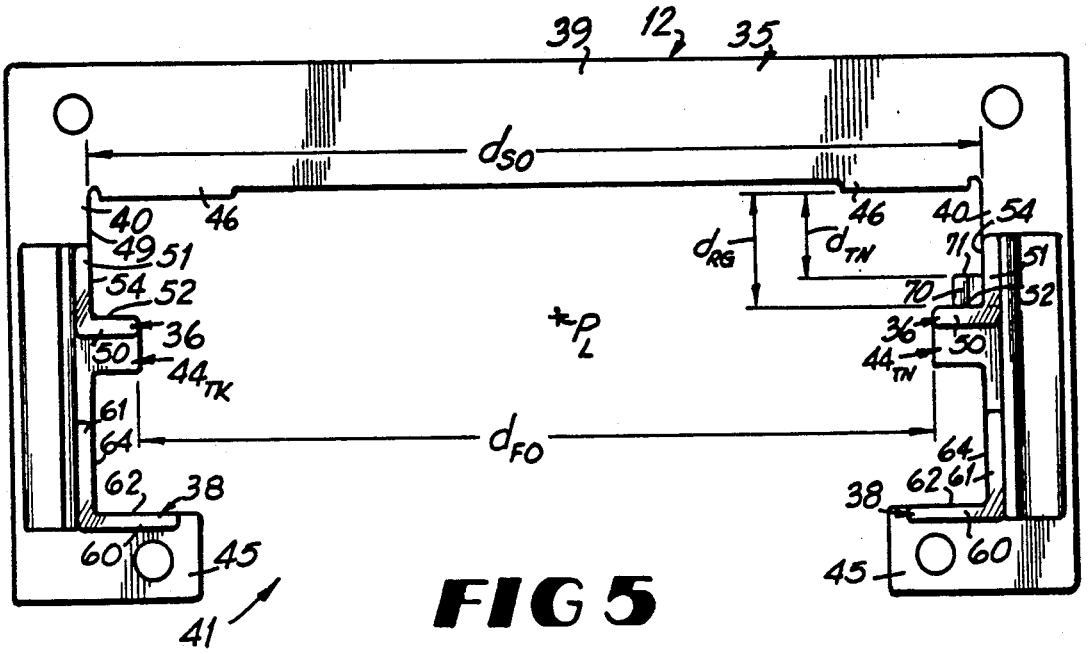
FIG. 5 is an enlarged end view of the pre-positioning guide assembly of the invention; and, FIG. 6 is a view similar to FIG. 4 with the gate on the guide assembly of FIG. 5.

The base member 35, best seen in FIGS. 2 and 5, has a general inverted U-shape with a top section 39 and a pair of depending legs 40 integral with opposite ends of the top section 39. The base member 35 defines a loading opening 41 therethrough corresponding to the cross-sectional shape of the loading opening LO in the frame VF. The base member 35 is attached to the frame VF around the entrance of the opening LO with attachment bolts 42 as best seen in FIG. 1.

As best seen in FIG. 2, each leg 40 includes a running gate loading tab 44 which projects into the loading opening 41 to support the running gate 11 while it is being checked for orientation. The two loading tabs 44 are horizontally aligned across the loading opening 41 and are axially aligned with the two running gate loading rails RGLR in the frame VF. The lower end of each of the legs 40 mounts a shroud gate loading flange 45 which projects into the loading opening 41 at a position spaced below the associated loading tab 44 so that the shroud gate will be supported. The two loading flanges 45 are also horizontally aligned across the loading opening 41 and are axially aligned with the two shroud gate loading rails SGLR in the frame VF.

The top section 39 defines a pair of depending gauging tabs 46 thereon facing the running gate loading tabs 44 and spaced thereabove a gaugeing distance $d_{RG}$. This distance is substantially equal to the running gate shoulder height $h_{SH}$ so that the running gate 11 will just clear the gauging tabs 46 when the bottom surfaces of the retainer side walls 19 are resting flat on the upper surfaces 48 of the loading tabs 44. Thus, if the gate is not lying flat on the tabs 44, the gate 11 will not pass through the loading opening 41. The inside edges 49 of legs 40 form the sides of the opening 41 and are spaced apart the distance $d_{SO}$ corresponding to the overall gate width $W_{RG}$.

Figure 6:
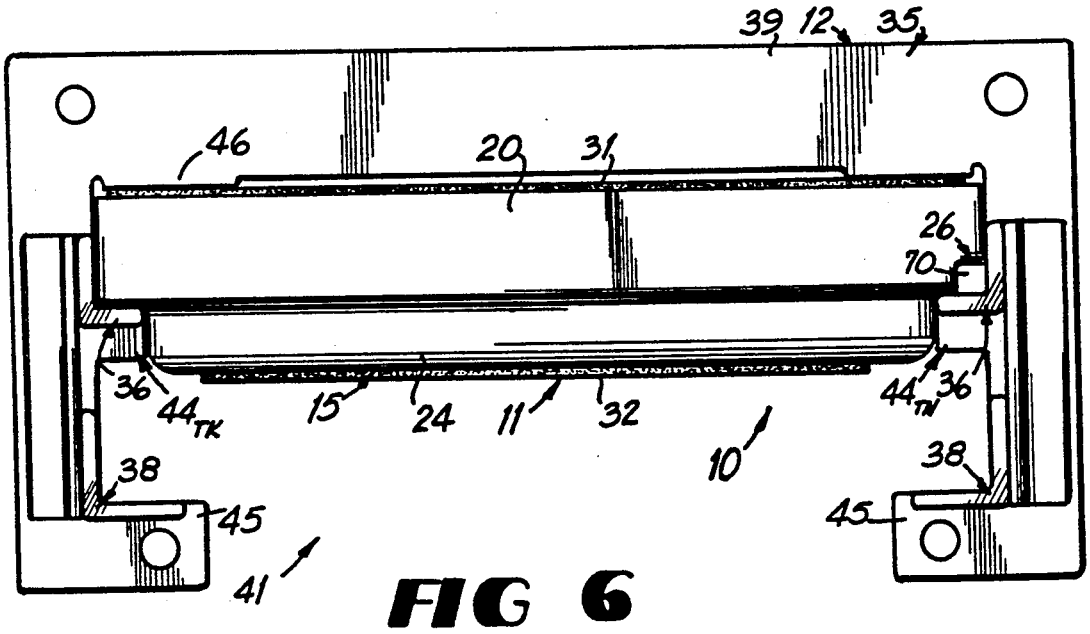

As best seen in FIG. 5, each of the running gate guide angles 36 includes an inwardly directed bottom support flange 50 and an upstanding side guide flange 51 along the outside edge of the flange 50. The flanges 50 are parallel to each other and spaced apart an opening distance $d_{FO}$ at their inside edges. The distance $d_{FO}$ is selected so that the inside edges of flanges 50 just clear the depending bottom lips 24 on the gate 11 when the bottom surfaces on gate 11 are supported on the upper support surfaces 52 on flanges 50 as seen in FIG. 6. The distance $d_{SO}$ between the inside surfaces 54 of side flanges 51 corresponds to the gate width $W_{RG}$ so that the flanges 51 laterally guide the gate 11 along the loading path $P_L$ with the loading axis $A_L$ of gate 11 in vertical registration with loading path $P_L$.

The angles 36 are arranged so that the support surfaces 52 are coplanar with the upper surfaces 48 on the loading tabs 44 on base member 35. In like manner, the inside surfaces 54 on flanges 51 are coplanar with the inside edges 49 on the base member 35.

Each of the shroud gate guide angles 38 includes an inwardly directed bottom support flange 60 and an upstanding side guide flange 61 along the outside edge of the flange 60. The flanges 60 are parallel to each other and support the gate assembly 14 on their upper support surfaces 62. The distance between the inside surfaces 64 of side flanges 61 corresponds to the width of the shroud gate assembly 14 so that the flanges 61 laterally guide the gate assembly 14 along the loading path $P_L$ with the loading axis $A_L$ of gate assembly 14 in vertical registration with loading path $P_L$ as will become more apparent.

The angles 60 are arranged so that the support surfaces 62 are coplanar with the upper surfaces 65 on the loading flanges 45 on base member 35. In like manner, the inside surfaces 64 on flanges 61 are coplanar with the inside edges 49 on the base member 35.

To insure that the running gate 11 can be loaded in only one orientation, a locating step 70 is provided on the locating tab $44_{TN}$ as seen in FIG. 2. The step 70 projects above the upper surface 48 of the tab $44_{TN}$ and defines an upper gauging surface 71 thereon parallel to and spaced below the gauging tab 46 a distance $d_{TN}$ seen in FIG. 5. The locating step 70 has a cross-sectional size and shape which are complementary to that of the recess 26 in gate 11 so that the bottom surface on retainer 16 can lie against the upper surface 52 on angle 36 only when the step 70 lies within the recess 26 in gate 11. Thus, the gate 11 will only pass through the base member 35 when the gate 11 is in its one correct orientation. While this may be changed, the location for recess 26 and step 70 shown is designed to orient the hole end 34 on gate 11 leading the gate into the frame VF as illustrated in FIG. 2. The gate 11 can be reversed simply by using a guide assembly 12 with the step 70 on the opposite tab 44. While the step 70 is illustrated as located on the tab 44, the length and location thereof is not critical as long as it is located close enough to the gauging tab 46 to raise the gate 11 so that it will not pass under the tab 46 if the recess 26 is not in registration with the step 70.

The recess/step combination may be located at other positions on the gate 11 and on the pre-positioning guide assembly 12. Likewise, this combination may be applied to the shroud gate 14 and work the same as for the gate 11.

What is claimed as invention is:

1. A gate for use in a valve mechanism where the gates are loaded into the mechanism along a loading path to a loaded position, said gate having a generally rectilinear shape; defining a generally planar sealing surface thereon adapted to form a seal in said valve mechanism when said gate is in the operative position in said valve mechanism; defining a loading axis along said sealing surface to be oriented generally in registration with the loading path in the valve mechanism during the loading of said gate to the loaded position in the valve mechanism; and including a pair of opposed sides thereon extending parallel said loading axis, one of which has a first thickness and the second of which has a second thickness greater than said first thickness so that said gate will load into the valve mechanism with only one orientation.

2. The gate of claim 1 wherein said side having said first thickness includes a thin section having said first thickness and a thick section having said second thickness.

3. The gate of claim 1 further including prepositioning guide means defining a gauging opening therethrough complementary to said gate so that said gate can only pass through said prepositioning guide assembly with the one orientation.

4. A gate for use in a valve mechanism where the gates are loaded into the mechanism to a loaded position along a loading path, said gate comprising:

(a) a metal retainer having a generally rectilinear shape, said retainer defining:
- a first central axis therethrough; and,
- a pair of opposed loading sides thereon generally parallel to said first central axis, one of said sides thinner than the other of said sides to permit said gate to be loaded into the loaded position along the loading path only when said retainer has a prescribed orientation with respect to the loading path.

5. The gate of claim 4 wherein said thinner loading side includes a thin section having a first thickness and a thick section having the same thickness as the opposite of said loading sides.

6. The gate of claim 5 further comprising:

a refractory member sized to fit in said metal retainer while defining a mortar space between said member and said retainer, said refractory member defining a clearance recess therein generally complementary to said thin section of said metal retainer defining said locating recess therein while forming the mortar space therebetween, said refractory member defining an upper planar sealing surface thereon parallel to said loading axis and a metal pour passage with a central axis perpendicular to said upper sealing surface; and, a refractory mortar filling said mortar space between said retainer and said refractory member and bonding said insert to said retainer.

7. The gate of claim 6 wherein said loading sides of said retainer define a pair of outside guide surfaces thereon parallel to the loading axis and the central axis of said metal pour passage; and wherein said locating recess opens onto one of said outside guide surfaces.

8. The gate of claim 7 wherein said refractory member further defines a lower planar sealing surface thereon parallel to said upper sealing surface.

9. The gate of claim 8 for use in the valve mechanism where said gate is moved from the loaded position into operative position in the mechanism along a firing path generally normal to the loading path, said retainer defining:

a firing central axis therethrough normal to said first central axis;

a pair of opposed operating ends thereon generally parallel to said firing central axis; and, a pair of operating support surfaces thereon adapted to support said retainer in the valve mechanism while said gate is in operative position, said operating support surfaces extending along said operating sides of said retainer.

10. A gate safety system for a valve mechanism where gates are to be loaded into the mechanism to a loaded position along a loading path comprising:

(a) a gate adapted to fit in said valve mechanism defining a loading axis to be oriented generally in registration with the loading path in the valve mechanism during the loading of said gate to the loaded position in the valve mechanism; and including a pair of opposed sides thereon extending parallel said loading axis, one of which has a first thickness and the second of which has a second thickness greater than said first thickness; and, (b) a pre-position guide defining a gauging opening therethrough complementary to said gate to require a single gate orientation to pass through said gauging opening as said gate is loaded into the valve mechanism.

11. The gate safety system of claim 10 wherein said gate comprises a metal retainer having a generally rectilinear shape, said retainer including a pair of spaced apart side walls generally parallel to the loading axis, one of said side walls including a thin section and a thick section so that said first thickness is at said thin section and said second thickness is at said thick section, said opposite side wall also at said second thickness; and, wherein said pre-position guide includes a pair of support tabs adapted to support said side walls of said retainer, one of said tabs including a step thereon sized and configured to fit against said thin section of said wall so that said gate will only pass through said guide when said gate has a prescribed single orientation.

12. The gate safety arrangement of claim 11 further including:

a refractory member sized to fit in said metal retainer while defining a mortar space between said member and said retainer, said refractory member defining a clearance recess therein generally complementary to said this section of said side wall of said metal retainer while forming the mortar space therebetween, said refractory member defining an upper planar sealing surface thereon parallel to said loading axis; and, a refractory mortar filling said mortar space between said retainer and said member and bonding said member to said retainer.

13. The gate safety system of claim 11 further comprising a refractory member cast into said metal retainer and defining an upper planar sealing surface thereon parallel to said loading axis.

14. The gate safety system of claim 12 wherein said refractory member further defines a lower planar sealing surface thereon parallel to said sealing surface.

* * * * *